US006824433B2

(12) United States Patent
Matsuda

(10) Patent No.: US 6,824,433 B2
(45) Date of Patent: Nov. 30, 2004

(54) TERMINAL FITTING

(75) Inventor: Yoshiki Matsuda, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/449,994

(22) Filed: May 30, 2003

(65) Prior Publication Data

US 2003/0224668 A1 Dec. 4, 2003

(30) Foreign Application Priority Data

May 31, 2002 (JP) ..... 2002-160163

(51) Int. Cl.[7] ..... H01R 13/15
(52) U.S. Cl. ..... 439/839
(58) Field of Search ..... 439/839, 843

(56) References Cited

U.S. PATENT DOCUMENTS 4,583,812 A * 4/1986 Gross et al. ..... 439/839
5,094,636 A * 3/1992 Zinn et al. ..... 439/839
5,350,321 A * 9/1994 Takenouchi ..... 439/839
5,360,356 A * 11/1994 May et al. ..... 439/839
5,664,972 A * 9/1997 Zinn et al. ..... 439/839
6,126,495 A * 10/2000 Lolic et al. ..... 439/839

FOREIGN PATENT DOCUMENTS

JP 3-55674 5/1991

* cited by examiner

*Primary Examiner*—Gary Paumen
(74) *Attorney, Agent, or Firm*—Gerald E. Hespos; Anthony J. Casella

(57) ABSTRACT

A terminal fitting (10) has a forwardly open tube (11) for receiving a male tab (T). An inner resilient contact piece (16; 22) has a base end (16A; 22A) unitary with a first wall of the tube (11) and an outer resilient contact piece (15; 21) has a base end (15A; 21A) unitary with a second wall of the tube (11). The respective base ends (15A, 21A; 16A, 22A) are in face-to-face contact, but a clearance (17; 23) is defined between the resilient contact pieces (16, 22; 15, 21) forward of the base ends (15A, 21A; 16A, 22A) prior to insertion of the male tab (T) into the tube (11). A male tab (T) can be inserted into the tube (11) and gradually closes the clearance (17; 23) from the rear end toward the front end. Thus, the support for resilient deformation shifts and stress concentrations are avoided.

14 Claims, 7 Drawing Sheets

TERMINAL FITTING

BACKGROUND OF THE INVENTION

1. Field of the Invention

The invention relates to a terminal fitting with resilient contact pieces.

2. Description of the Related Art

Japanese Unexamined Utility Model Publication No. 3-55674 discloses a terminal fitting with opposite front and rear ends. A rectangular tube is formed at the front end of the terminal fitting and a resilient contact piece is in the rectangular tube. The resilient contact piece is supported at only one end and extends along forward and backward directions. A male tab inserted into the rectangular tube portion deforms the resilient contact piece. As a result, the male tab is pressed resiliently between a ceiling wall of the rectangular tube and the resilient contact piece with a specified contact pressure attributable to a restoring force accumulated in deformed the resilient contact piece.

The above-described terminal fitting could be miniaturized by reducing the thickness of the resilient contact piece. However the smaller resilient contact piece might not reliably achieve the specified contact pressure.

Two resilient contact pieces could be placed one over in an effort to increase the contact pressure. For example, FIG. 7 shows a terminal fitting with an upper resilient contact piece 101A that will contact a male tab (unillustrated) and a lower resilient contact piece 101B that will not contact the male tab. The two resilient contact pieces 101A, 101B are held in close contact with each other over substantially the entire length from base end portions 103A, 103B to extending end portions 102A, 102B. The extending end portion 102A of the upper resilient contact piece 101A is pressed by the male tab from above. Thus, both the upper and lower resilient contact pieces 101A and 101B are displaced resiliently down. As a result, the resilient forces accumulated in the two resilient contact pieces ensure a higher contact pressure.

The upper and lower resilient contact pieces 101A, 101B are held in close contact with each other over substantially the entire length from the base end portions 103A, 103B to the extending end portions 102A, 102B. The two resilient contact pieces 101A, 101B are deformed resiliently as the male tab is inserted and are displaced down together while being held in close contact with each other. The base end portions 103A, 103B are the supporting points for this resilient deformation. Thus, the deformation supporting points remain unchanged in the process of resiliently displacing the resilient contact pieces 101A, 101B, and stress is concentrated on the deformation supporting points at the base end portions 103A, 103B of the resilient contact pieces 101A, 101B.

The present invention was developed in view of the above problem and an object thereof is to prevent the concentration of a stress at resilient contact pieces.

SUMMARY OF THE INVENTION

The invention relates to a terminal fitting with a plurality of resilient contact pieces at least partly placed substantially one over another and extending in forward and backward directions. Base ends of the resilient contact pieces are held substantially in close contact with each other. However, a clearance is defined between at least parts of the resilient contact pieces when a male tab is unconnected. The male tab presses the resilient contact pieces during a connecting operation, and extends a close contact area between the resilient contact pieces from the base ends toward the extending ends.

The resilient contact pieces deform resiliently as the male tab is connected to displace portions of the resilient contact pieces corresponding to the clearance therebetween. The ends of the resilient contact pieces that are in close contact are the supporting point about which the resilient contact pieces deform. Thus, the supporting point of the resilient deformation of the resilient contact pieces is displaced toward the extending ends as the close contact area of the resilient contact pieces is extended form the base ends toward the extending ends during the connection of the male tab. Therefore, the supporting point of the resilient deformation of the resilient contact pieces is not fixed at one position, and the concentration of stress during the resilient deformation can be avoided.

A contact portion at an extending end of the resilient contact piece closest to the male tab is pressed by the male tab. Thus, the resilient contact pieces are deformed to accumulate resilient restoring forces that ensure a contact pressure between the male tab and the resilient contact pieces.

The resilient contact pieces preferably are in close contact when the male tab is connected. Further, the resilient contact pieces have the clearance when the male tab is unconnected, but are held substantially in contact with each other at a position more toward the extending ends thereof than the clearance.

At least one resilient contact may piece have a weakened portion formed by reducing a lateral cross section normal to the extending direction of the resilient contact piece. The resilient contact piece has a lower rigidity where the weakened portion is formed, and hence stress is distributed over the area where the weakened portion is formed when the resilient contact piece is deformed. As a result, stress acting on the supporting point of the resilient deformation of the resilient contact pieces is reduced.

At least one of the resilient contact pieces is curved slightly to have a concave side facing inwardly in a free state where the male tab is not connected.

A clearance narrower than the thickness of the male tab preferably is defined between a contact portion of the resilient contact piece and an opposite plate of the terminal fitting when the resilient contact pieces are in a free state.

At least one resilient contact piece comprises a curved portion extending from an extending end of a substantially flat portion. The convexly curved portion faces in a resiliently deforming direction of the plurality of the resilient contact pieces.

At least one of the plurality of the resilient contact pieces comprises an embossment for contact the male tab.

The clearance preferably opens forwardly when the male tab is unconnected.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
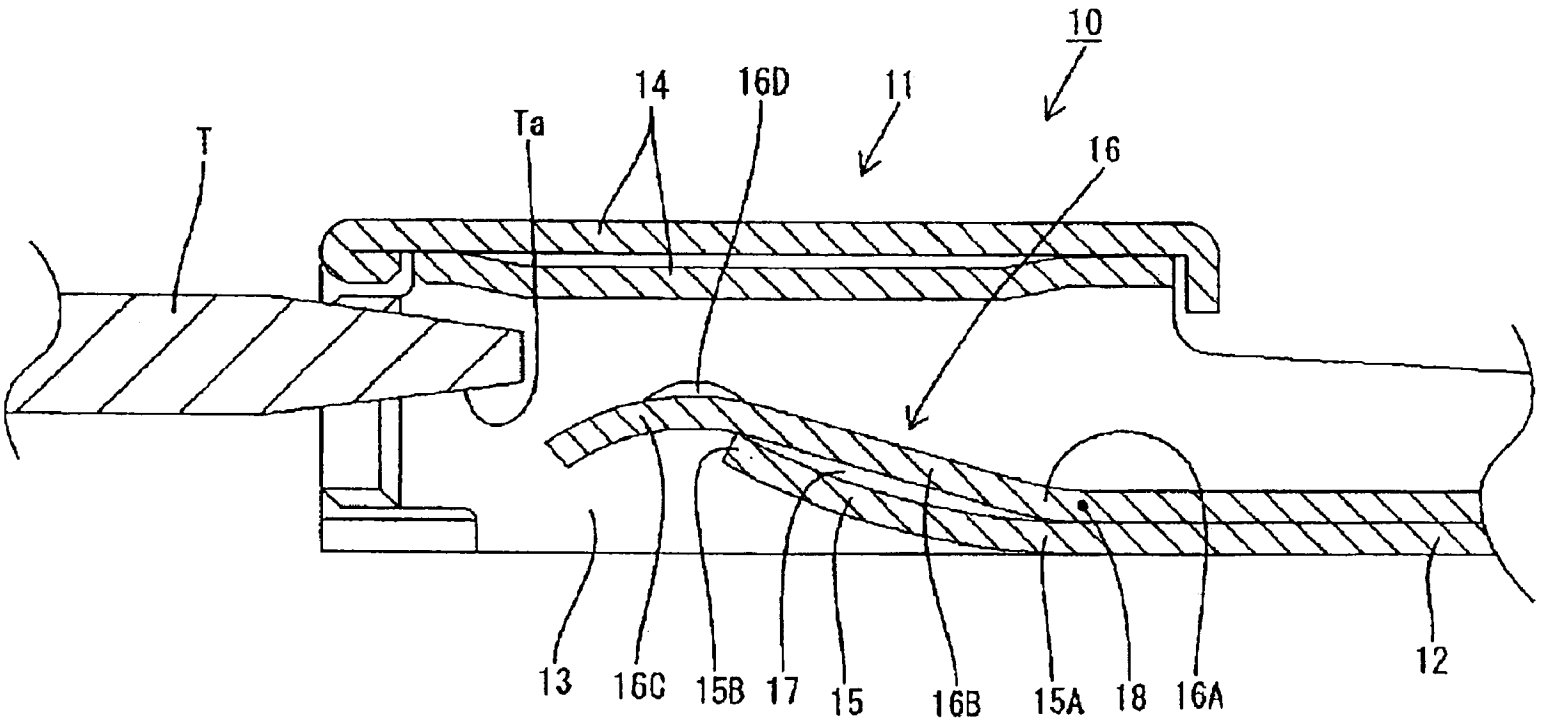
FIG. 1 is a longitudinal sectional view of a terminal fitting according to a first embodiment of the present invention showing a state immediately before a male tab is connected with a resilient contact piece.
Figure 2:
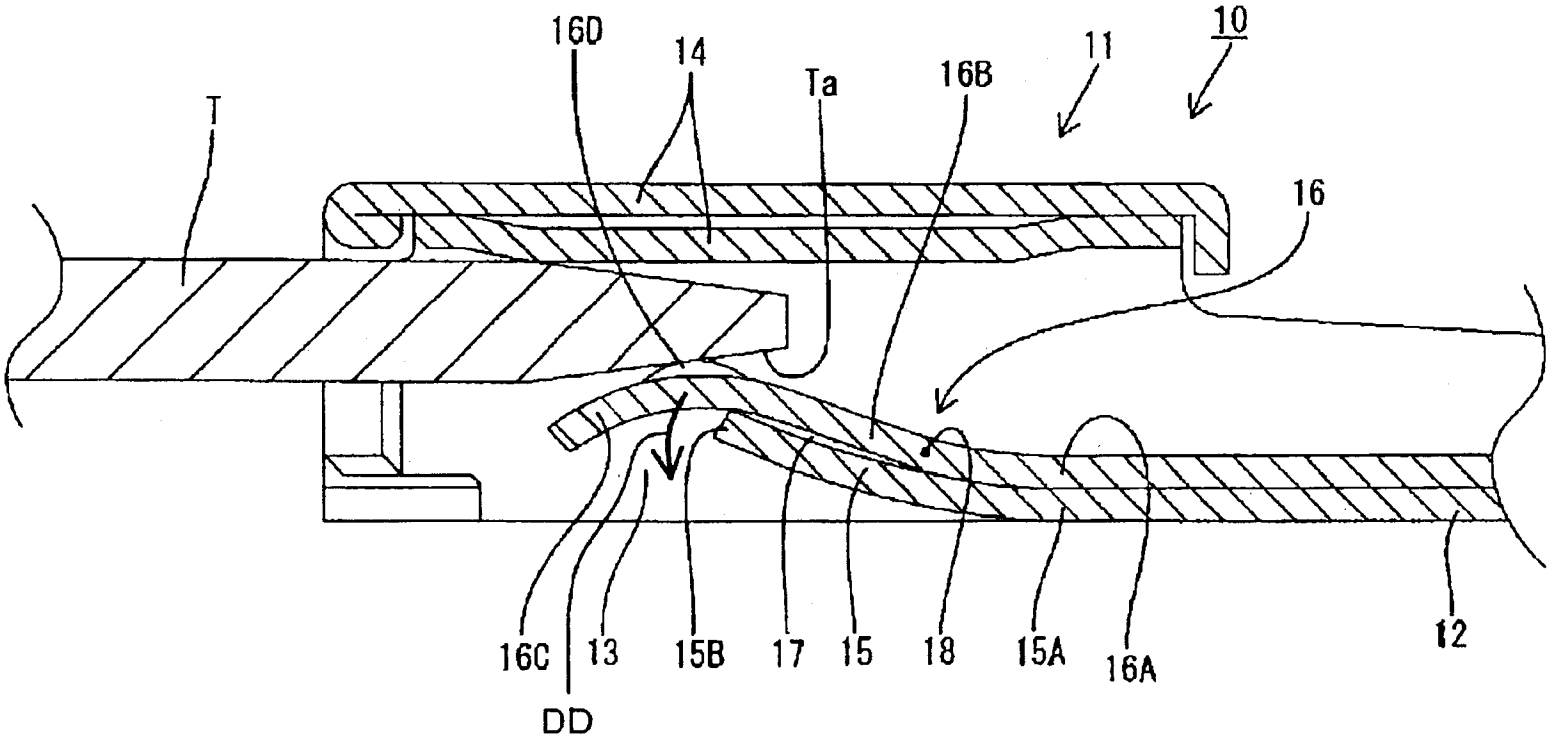
FIG. 2 is a longitudinal section of the terminal fitting showing an intermediate stage of connecting the male tab with the resilient contact piece.
Figure 3:
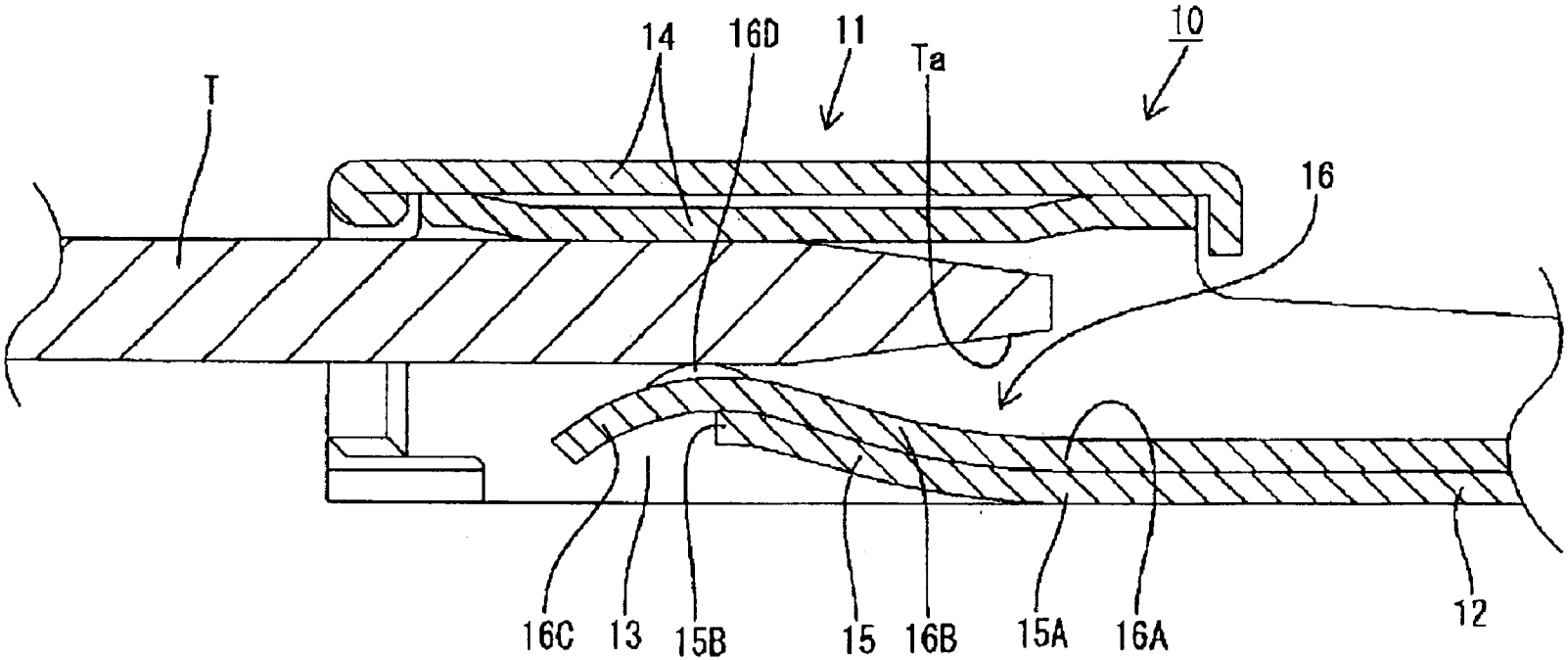
FIG. 3 is a longitudinal sectional view of the terminal fitting showing a state where connection of the male tab and the resilient contact piece is complete.

A terminal fitting according to a first embodiment of the invention is identified by the numeral 10 in FIGS. 1 to 3. The terminal fitting 10 has a substantially rectangular tube 11 at the front end thereof and an unillustrated wire connection portion at the rear end of the rectangular tube 11. The wire connection portion is crimped, bent, folded or welded into connection with an unillustrated wire or connected by insulation displacement with the wire. The terminal fitting 10 is to be inserted into a connector housing (unillustrated) and is electrically connectable with a male Tab T to be inserted into the rectangular tube 11 from the front. A leading end Ta of the male tab T is tapered to be thinner toward its tip.

In the following description, a mating side with the male tab T (left side in FIGS. 1 to 3) is referred to as the front, and reference is made to FIGS. 1 to 3 concerning the vertical direction.

The substantially rectangular tube 11 has a bottom plate 12 coupled to the wire connection portion. A pair of side plates 13 stand up from the opposite left and right sides of the bottom plate 12 and a pair of ceiling plates 14 extend in substantially normal from the upper ends of the opposite side plates 13. The ceiling plates 14 are placed substantially one over the other.

Upper and lower resilient contact pieces 15, 16 are formed in the substantially rectangular tube 11. The lower resilient contact piece 15 is formed by cutting a part of the bottom plate 12 and bending the cut part obliquely up. More particularly, the lower resilient contact piece 15 defines a cantilever with a rear base end 15A joined unitarily to the bottom plate 12. Portions of the lower resilient contact piece 15 forward of the base end 15A are curved slightly and have a concave side facing inwardly in a free state (see FIG. 1) where the male tab T is not connected.

The upper resilient contact piece 16 has a base end 16A that extends unitarily from a lower edge of either one of the left and right side plates 13. The base end 16A of the upper resilient contact piece 16 is held substantially in close contact with the upper surface of the bottom plate 12. The upper resilient contact piece 16 further has a substantially flat portion 16B that extends obliquely up to the front substantially along the lower resilient contact piece 15. A curved portion 16C extends from an extending front end of the substantially flat portion 16B and is curved to have the convex portion facing up. A peak on the upper surface of the curved portion 16C is embossed to project upward, thereby forming a substantially spherical contact portion 16D to be brought into contact with the lower surface of the male tab T. A clearance narrower than the thickness of the male tab T is defined between the contact portion 16D and the lower surface of the lower ceiling plate 14 when the resilient contact pieces 15, 16 are in the free unbiased state undeformed by the male tab T.

The curved shape of the lower resilient contact piece 15 creates a clearance 17 between the lower surface of the substantially flat portion 16B and the upper surface of the lower resilient contact piece 15 when the resilient contact pieces 15 and 16 are in the free state. Further, the upper edge of the extending end 15B of the lower resilient contact piece 15 is held substantially in contact with the lower surface of the curved portion 16C of the upper resilient contact piece 16 when the resilient contact pieces 15 and 16 are in the free state. Thus, the clearance 17 is defined between the base ends 15A, 16A of the two resilient contact pieces 15, 16 and the extending end 15B of the lower resilient contact piece 15. Further, the curved portion 16C is substantially in contact with the lower resilient contact piece 15 at a portion thereof sloped obliquely up to the front and more backward than the contact portion 16D.

The male tab T is connected with the female terminal fitting 10 from the front mating side so that the lower surface of the tapered leading end Ta of the male tab T enters the rectangular tube 11 and contacts the contact portion 16D from above. The male tab T is inserted further into the rectangular tube 11 so that the tapered leading end Ta of the male tab T presses the contact portion 16D of the upper resilient contact piece 16 down in a deforming direction DD. Thus, the upper resilient contact piece 16 is deformed resiliently down in the deforming direction DD.

A supporting point 18 of the resilient deformation of the upper resilient contact piece is displaced forward as the deformation progresses. Specifically, the front of the base end 16A of the upper resilient contact piece 16 is the supporting point 18 of the resilient deformation at the start of the resilient deformation. Further resilient deformation presses the upper resilient contact piece 16 back in the insertion direction of the male tab T at the contact portion 16D of the extending end thereof. As a result, the substantially flat portion 16B buckles and curves down. Accordingly, the rear end of the substantially flat portion 16B contacts the upper surface of the lower resilient contact piece 15 (see FIG. 2). The substantially flat portion 16B buckles further as the deformation of the upper resilient contact piece 16 proceeds. Consequently, a substantially middle section of the flat portion closely contacts the lower resilient contact piece 15. A close contact area between the two resilient contact pieces 15, 16 extends from the base ends 15A, 16A toward the extending ends as the resilient deformation progresses, and the clearance 17 gradually disappears from the rear end thereof.

The extending end 15B of the lower resilient contact piece 15 is pressed by the upper resilient contact piece 16 and is deformed down and made flatter as the resilient deformation of the upper resilient contact piece 16 progresses.

The clearance 17 between the resilient contact pieces 15 and 16 substantially disappears when the male tab T is connected completely, and the two resilient contact pieces 15, 16 are held in close contact with each other over substantially the entire length of the lower resilient contact piece 15 from the base end 15A to the extending end 15B (see FIG. 3).

Both the upper and lower resilient contact pieces 15, 16 are deformed resiliently in this state. Thus, a specified contact pressure is ensured between the upper resilient contact piece 16 and the male tab T by a larger resilient force, which is a sum of the resilient restoring forces of the two resilient contact pieces 15, 16.

The clearance 17 is defined in the resiliently deforming direction DD of the resilient contact pieces 15, 16 between the lower and upper resilient contact pieces 15, 16 when the male tab T is not connected. However, the upper resilient contact piece 16 undergoes a resilient deformation in the deforming direction DD during connection of the male tab T. This deformation of the upper resilient contact piece 16 occurs primarily in an area corresponding to the clearance 17 between the resilient contact pieces 15, 16. Additionally, the end forward end of the area of close contact between the lower and upper resilient contact pieces 15 and 16 is the supporting point for the resilient deformation of the upper resilient contact piece 16.

In this way, the supporting point 18 of the resilient deformation of the resilient contact piece 16 is displaced toward the forward mating side as the close contact area of the two resilient contact pieces 15, 16 extends forward from the base ends 15A, 16A to the extending end 15B during the connection of the male tab T. Accordingly, the supporting point 18 of the resilient deformation of the resilient contact piece 16 is not fixed, and stress is distributed over substantially the entire flat portion 16B of the resilient contact piece 16 during the resilient deformation, with the result that the local concentration of stress is avoided.

Next, a second preferred embodiment of the present invention is described with reference to FIG. 4.

Figure 4:
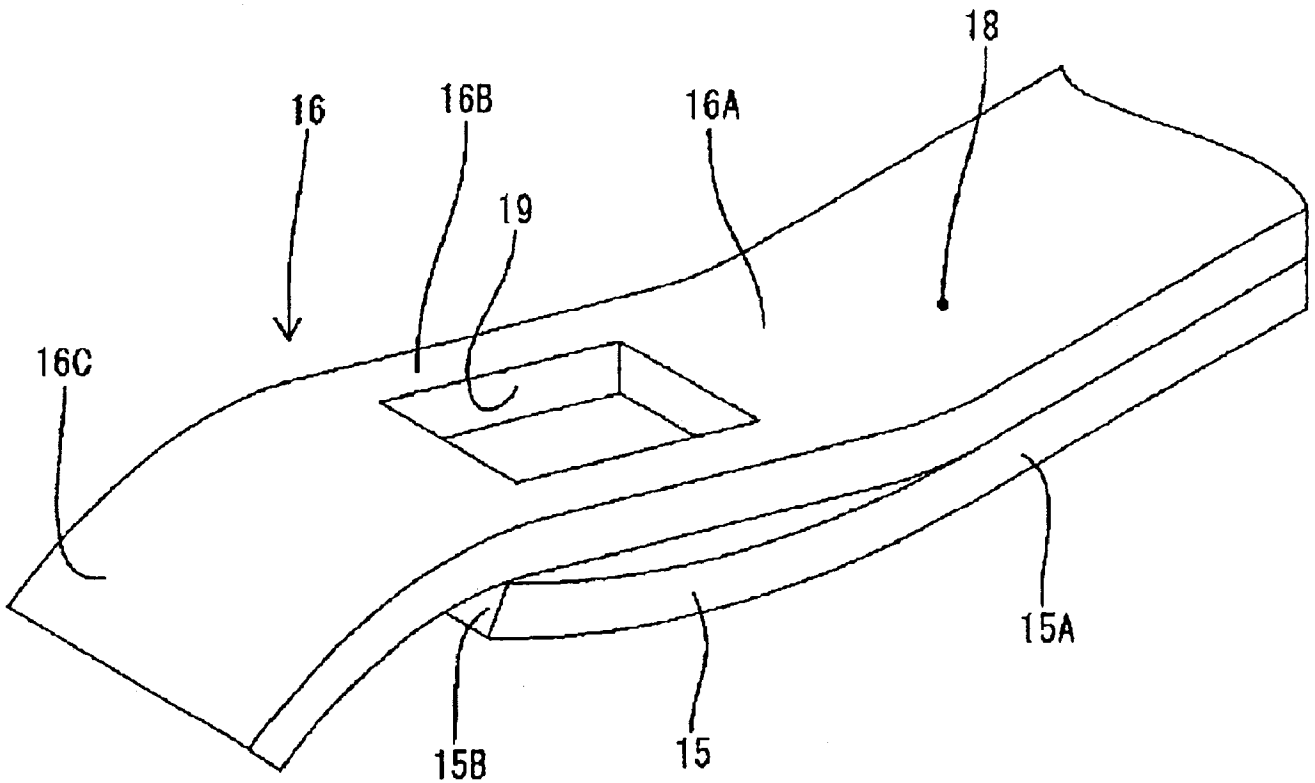
FIG. 4 is a perspective view of resilient contact pieces of a second embodiment.

A second embodiment is illustrated in FIG. 4 and has a substantially rectangular window 19 formed in the substantially flat portion 16B of the upper resilient contact piece 16. Portions of the upper resilient contact piece 16 at the window 19 have a smaller lateral cross section normal to the extending direction of the resilient contact piece 16 as compared to a portion where the window 19 is not formed. The resilient contact piece 16 has a lower rigidity at the window 19 and stress is distributed over the portion where the window 19 is formed during the resilient deformation of the resilient contact piece 16. As a result, stress at a supporting point 18 of the resilient deformation of the resilient contact piece 16 is reduced. The other construction in FIG. 4 is similar to or the same as the first embodiment. Thus, no description is given on the construction, functions and effects thereof by identifying the similar or same construction by the same reference numerals.

Figure 5:
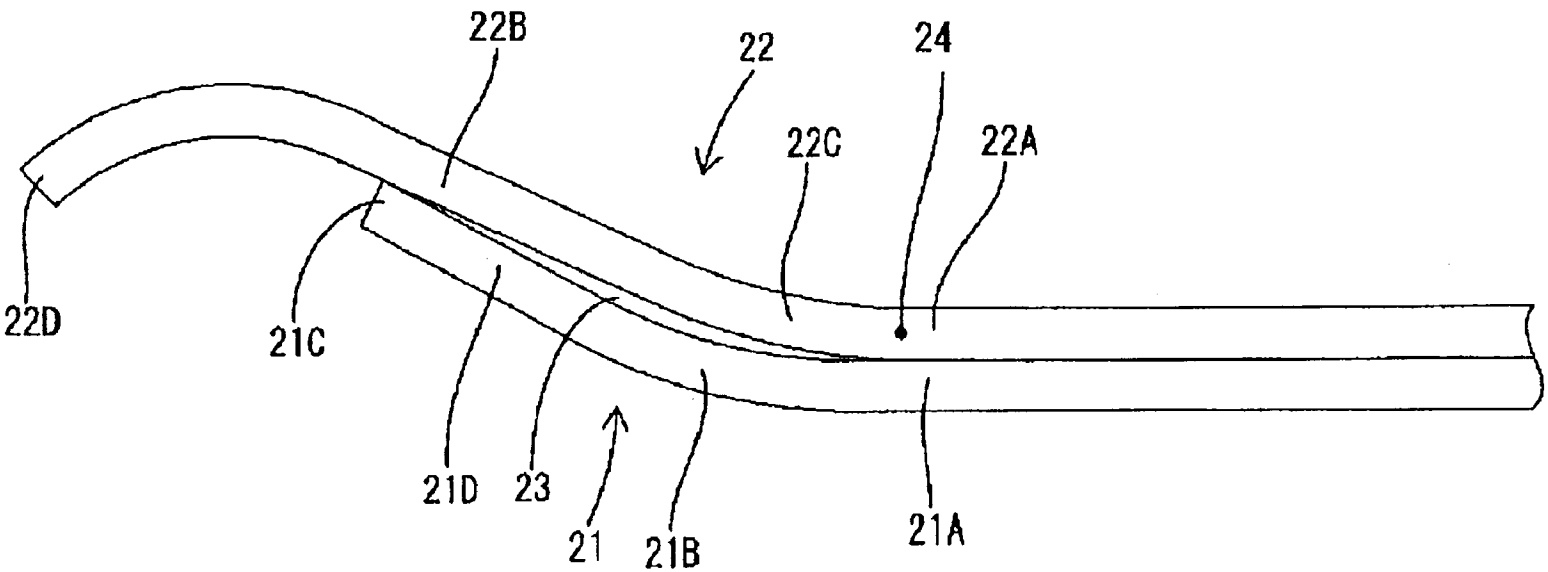
FIG. 5 is a side view of resilient contact pieces of a third embodiment.
Figure 6:
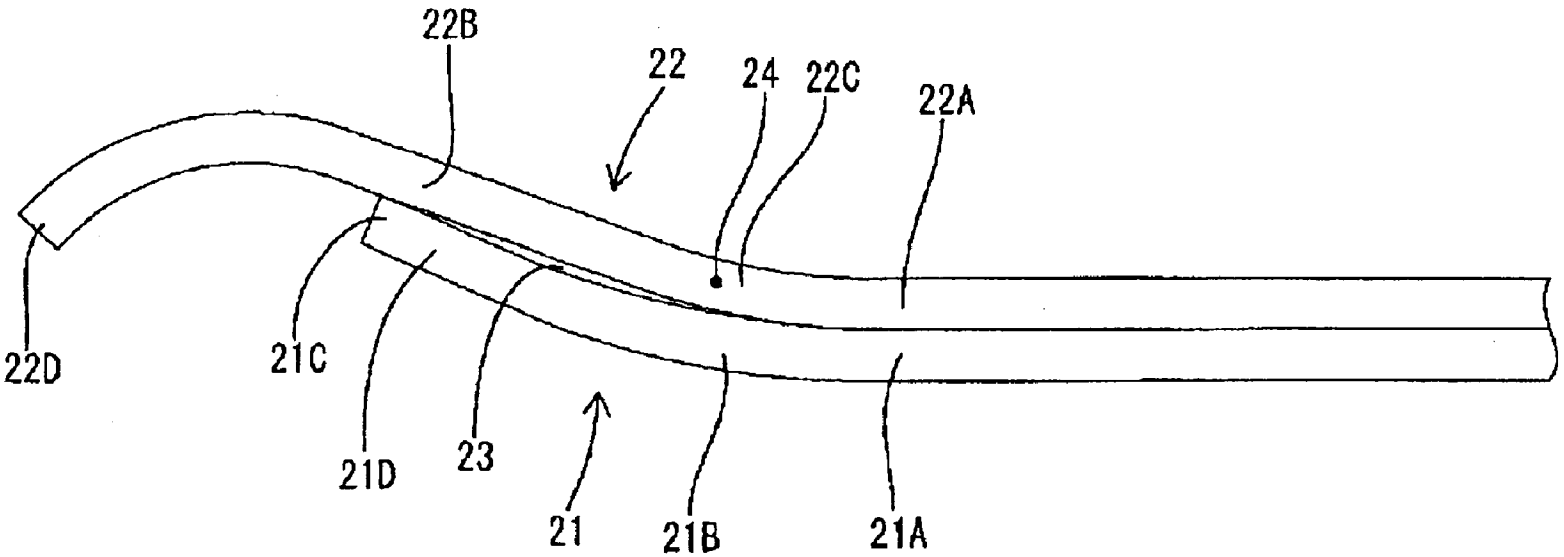
FIG. 6 is a side view showing a progressed state of the resilient deformation of the resilient contact pieces.
Figure 7:
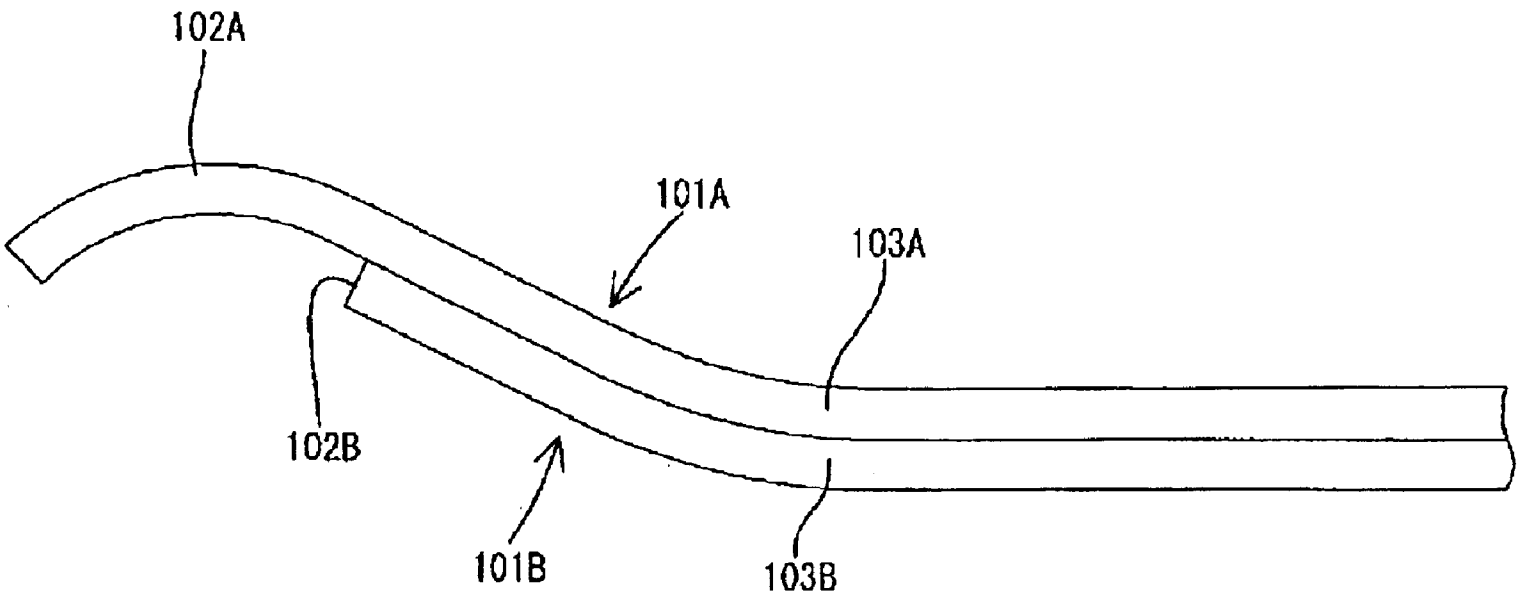
FIG. 7 PRIOR ART
FIG. 7 is a side view of prior art resilient contact pieces.

A third embodiment of the invention is illustrated in FIGS. 5 and 6. The third embodiment has a lower resilient contact piece 21 with a base end 21A. A rear half 21B of the lower resilient contact piece 21 forward of the base end 21A is curved to have a concave upper surface. The lower resilient contact piece 21 also has a front extending end 21C, and a front half 21D of the lower resilient contact piece 21 near the front extending end 21C is substantially flat. The third embodiment also has an upper resilient contact piece 22 with a base-end 22A, a substantially flat portion 22B and a base end curved portion 22C with a concave upper surface between the base end 22A and the substantially flat portion 22B. The upper resilient contact piece 22 further has a front end 22D. A clearance 23 is defined between the two resilient contact pieces 21, 22. Approximately a rear half of the clearance is formed between the curved portions 21 B, 22C and approximately a front half of the clearance 23 is formed between the flat portions 21D, 22B. A supporting point 24 of the resilient deformation is displaced forward when the two resilient contact pieces 21, 22 are deformed resiliently and the clearance 23 disappears from the rear end thereof, as shown in FIG. 6.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

Two resilient contact pieces are placed one over the other in the foregoing embodiments. However, the invention is also applicable to a case where three or more resilient contact pieces are placed substantially one over another. In this case, all the resilient contact pieces may be placed one over another with no clearance left therebetween when the male tab is connected or a clearance may be left between some resilient contact pieces.

The resilient contact pieces extend forward substantially opposite from the inserting direction of the male tab being supported at only one end in the forgoing embodiments. However, the resilient contact pieces may extend backward in the same direction as the inserting direction of the male tab while being supported only at one end according to the present invention.

The upper resilient contact piece is longer than the lower resilient contact piece in the foregoing embodiments. However, the upper resilient contact piece may be shorter than or substantially equal to the lower resilient contact piece according to the present invention.

The extending end of the lower resilient contact piece in the foregoing embodiments is more toward the base end than the contact portion of the upper resilient contact piece. However, the extending end of the lower resilient contact piece may be more toward the extending end than the contact portion of the upper resilient contact piece while the lower resilient contact piece remains shorter than the upper resilient contact piece.

In the foregoing embodiments, the two resilient contact pieces are placed substantially one over the other with no clearance left therebetween in the connected state with the male tab. However, according to the present invention, the clearance may be partly left between the two resilient contact pieces when the connection of the male tab is completed. Accordingly, the clearance may be progressively or gradually reduced during the connection or insertion of the male tab independently of whether a smaller clearance remains at the end of the connection or not.

The two resilient contact pieces contact each other at a position more toward the extending ends than the clearance in the illustrated embodiments. However, the two resilient contact pieces may closely contact each other only at the base ends and the clearance may be open toward the extending front ends. In this case, the clearance may be left open toward the extending ends or the resilient contact pieces may have no clearance left therebetween when the connection of the male tab is completed.

The lower resilient contact piece is formed in the foregoing embodiments by cutting the base plate of the rectangular tube and lifting the cut portion, and the upper resilient contact piece extends from the side plate. However, the upper resilient contact piece may be formed by cutting the bottom plate of the rectangular tube and lifting the cut portion, and the lower resilient contact piece may extend from the side plate. Alternatively or additionally, the base plate may be folded so as to have two or more plate layers and the two or more resilient contact pieces may be formed by suitably cutting these plate layers.

The resilient contact piece is provided with the window in the second embodiment as a means for forming the weakened portion. However, the weakened portion may be formed by cutting the side edges of the resilient contact piece away to narrow its width or reduce its cross section along a direction substantially normal to the inserting direction of the male tab.

The weakened portion is provided only at the upper resilient contact pieces in the foregoing second embodiment. However, the weakened portion may be at only the lower resilient contact piece or may be provided at both the upper and lower resilient contact pieces according to the present invention.

What is claimed is:

1. A terminal fitting with a plurality of resilient contact pieces placed substantially one over another and extending in forward and backward directions while having base ends thereof held substantially in close contact with each other, wherein:

when a male tab is unconnected, a clearance is defined between at least part of the resilient contact pieces, and in the process of connecting the male tab thereby pressing the contact portion by the male tab being connected, a closed contact area between the resilient contact pieces defining the clearance therebetween is extended from the base ends toward the extending ends of the resilient contact pieces so that the resilient contact pieces are brought into close contact with each other with no clearance therebetween when the connection of the male tab is completed.

2. The terminal fitting of claim 1, wherein, a contact portion at an extending end of the closest one of the resilient contact pieces to the male tab is pressed by the male tab, whereby the resilient contact pieces are deformed resiliently to accumulate restoring forces for ensuring a contact pressure between the male tab and the resilient contact pieces.

3. The terminal fitting of claim 1, wherein, when the male tab is unconnected, the resilient contact pieces are held substantially in contact with each other at a position more toward the extending ends thereof than the clearance.

4. The terminal fitting of claim 1, wherein at least one of the resilient contact pieces comprises a weakened portion formed by partly reducing a lateral cross section thereof normal to the extending direction of the resilient contact piece.

5. The terminal fitting of claim 1, wherein at least one of the resilient contact pieces has a concave side facing inwardly in a free state where the male tab is not connected.

6. The terminal fitting of claim 1, wherein, when the resilient contact pieces are in a free state where they are not resiliently deformed, a clearance narrower than the thickness of the male tab is defined between a contact portion thereof and an opposite plate of the terminal fitting.

7. The terminal fitting of claim 1, wherein at least one of the resilient contact pieces comprises a curved portion extending from an extending end of a substantially flat portion while being convexly curved facing in a resiliently deforming direction of the resilient contact pieces.

8. The terminal fitting of claim 1, wherein at least one of the resilient contact pieces comprises an embossed portion for contacting the male tab.

9. The terminal fitting of claim 1, wherein the clearance is open substantially forwardly when the male tab is unconnected.

10. A terminal fitting having opposite front and rear ends, portions of the terminal fitting substantially adjacent the front end defining a tube open at the front end for receiving a male tab, an inner resilient contact piece having a base end unitary with a first wall of the tube and an extending end cantilevered inwardly into said tube, portions of the inner resilient contact piece between the base end and the extending end defining an inwardly convex curve for contacting the male tab, and an outer resilient contact piece having a base end unitary with a second wall of the tube and in face-to-face contact with the base end of the inner resilient contact piece, the outer resilient contact piece further having an extending end, portions of the outer resilient contact piece between the base end and the extending end defining an inwardly concave curve such that a clearance is defined between the outer and inner resilient contact pieces prior to insertion of the male tab into the tube, wherein the inner resilient contact piece is deformable outwardly during insertion of the male tab for substantially closing the clearance between the inner resilient contact piece and the outer resilient contact piece in a rear-to-front direction.

11. The terminal fitting of claim 10, wherein at least one of the resilient contact pieces comprises a weakened portion formed by partly reducing a lateral cross section thereof normal to the extending direction of the resilient contact piece.

12. The terminal fitting of claim 10, wherein the inner resilient contact piece comprises an embossment for contacting the male tab.

13. The terminal fitting of claim 10, wherein the extending end of the outer resilient contact piece contacts the inner resilient contact piece forward of the clearance.

14. The terminal fitting of claim 10, wherein the extending end of the outer resilient contact piece contacts the inner resilient contact piece rearward of the inwardly convex curve.

* * * * *